US008167172B2

(12) United States Patent
Yeames

(10) Patent No.: US 8,167,172 B2
(45) Date of Patent: May 1, 2012

(54) COMPRESSED GAS / CARBON DIOXIDE / HYDRAULIC FLUID DISPENSER

(75) Inventor: James E. Yeames, Dover, NH (US)

(73) Assignee: Advanced Fluid Product Development, LLC, Dover, NH (US)

( * ) Notice: Subject to any disclaimer, the term of this patent is extended or adjusted under 35 U.S.C. 154(b) by 1052 days.

(21) Appl. No.: 12/013,684

(22) Filed: Jan. 14, 2008

(65) Prior Publication Data

US 2008/0210708 A1 Sep. 4, 2008

Related U.S. Application Data

(60) Provisional application No. 60/892,741, filed on Mar. 2, 2007.

(51) Int. Cl.
*B67D 7/70* (2010.01)

(52) U.S. Cl. ..... 222/137; 222/334; 222/389; 60/593

(58) Field of Classification Search ..... 222/137, 222/334, 389, 399; 60/560, 593
See application file for complete search history.

(56) References Cited

U.S. PATENT DOCUMENTS 3,605,745 A * 9/1971 Hodosh ..... 604/143
3,646,833 A * 3/1972 Watson ..... 74/589
4,028,473 A * 6/1977 Conti ..... 427/434.7
4,342,310 A * 8/1982 Lindmayer et al. ..... 604/70
4,478,669 A 10/1984 Zeller et al.
4,944,726 A * 7/1990 Hilal et al. ..... 604/143
5,026,187 A 6/1991 Belanger et al.
5,181,636 A * 1/1993 Anderson et al. ..... 222/389
6,425,897 B2 * 7/2002 Overes et al. ..... 606/93
6,662,969 B2 * 12/2003 Peeler et al. ..... 222/1
6,935,541 B1 8/2005 Campbell et al.
6,957,747 B2 10/2005 Peeler et al.
2004/0074927 A1 4/2004 Lafond

FOREIGN PATENT DOCUMENTS

JP 09075822 A 3/1997

* cited by examiner

*Primary Examiner* — Kevin P Shaver
*Assistant Examiner* — Daniel R Shearer
(74) *Attorney, Agent, or Firm* — Mesmer & Deleault, PLLC

(57) ABSTRACT

A fluid dispensing apparatus having a) a compressed gas or $CO_2$ cartridge controller, b) a hydraulic pressure medium connected to the $CO_2$ cartridge controller, c) a flow control valve connected to the hydraulic pressure medium; and d) a hydraulic piston connected to the hydraulic pressure medium, whereby a $CO_2$ cartridge applies pressure to the hydraulic pressure medium controlled by the $CO_2$ cartridge controller, the flow control valve is operated to precisely meter hydraulic fluid to the hydraulic piston, and the hydraulic piston provides the linear force to dispense a fluid product with similar and matching regulation under pressure. A rotary valve can be provided to use spent $CO_2$ to retract the piston.

13 Claims, 4 Drawing Sheets

COMPRESSED GAS / CARBON DIOXIDE / HYDRAULIC FLUID DISPENSER

BACKGROUND

1. Field of the Invention

The invention is in the field of fluid metering and dispensing.

2. Description of the Related Art

A common method of dispensing many different fluids is to apply pressure to a contained volume of the fluid at which point the fluid will flow through an available outlet valve, nozzle, or orifice. When the pressure is released, flow will cease providing that the contained volume of fluid is not compressible due to entrapped or entrained air or other gas. Optionally, the contained volume of fluid is pressurized and then released through a valve mechanism operated either manually or remotely. Flow will cease when the valve is returned to a closed position. This in turn allows any entrapped or entrained air or other gas in the fluid to compress resulting in a spurt of contained fluid on subsequent openings of the valve. A common example is dispensing caulk with a caulking gun. Other examples include grease, molding and dental impression materials, one or two part epoxies, and other adhesives, sealants, pastes, powders, compounds and fluids. In a caulking gun, a tube containing a fluid or a paste is compressed on one end by plunger powered by the action of an operator's hand. The pressure applied to the contained volume of caulk expands the somewhat elastic container and compresses any contained gases. This results in significant afterflow or run-on following removal of the operator's pressure input.

This apparatus may be sufficient for infrequent use. However, for large jobs higher viscosity fluids, increased flow rates or industrial use, muscle power is not enough. The operator would quickly become fatigued or injured from the repeated motion.

One solution that has been tried is to attach a power source to the dispenser, such as a hose with pressurized air or fluid connected, through a valve, to a cylinder or actuator which multiplies the input pressure and resultant forces so as to make dispensing easier. However, air hoses and other power sources make the dispenser difficult to handle with precision. The hoses are stiff, and act as a tether, restricting the movement of the operator. The operator often has great difficulty working against the pull of the hoses. To stop the flow in (especially) the pneumatic varieties, the pressurized air is vented to the atmosphere to pause or halt the flow of dispensed fluid. This requires large reservoirs of pressurized media to be fully functional since the pressurization is lost at each pause.

Another solution that has been tried has been to use battery packs and motors. However, batteries are expensive, heavy and burdensome; present disposal problems; and require frequent recharging for significant periods of time. In addition, neither of these solutions addresses the problem of afterflow or run-on following removal of the operator's pressure input.

What is needed, therefore, is a fluid dispensing apparatus that is both lightweight and untethered which is capable of more positive flow control and elimination of the afterflow or run-on following removal of the fluid pressure input.

SUMMARY

The invention is an apparatus that fulfills the need for a fluid dispenser that is both lightweight, untethered, and allows precise flow control of both compressible and non-compressible fluids. A fluid dispensing apparatus according to the present invention comprises a) a disposable or refillable cartridge containing $CO_2$ or another compressed gas power source, b) an incompressible hydraulic pressure medium operatively coupled to the $CO_2$ cartridge controller, c) a flow control valve operatively coupled to the incompressible hydraulic pressure medium; and d) a moveable hydraulic piston in a cylinder operatively coupled to the incompressible hydraulic pressure medium, whereby a $CO_2$ cartridge applies pressure to the incompressible hydraulic pressure medium controlled by the $CO_2$ cartridge controller, the flow control valve is operated at various and variable openings to precisely meter the flow of the incompressible hydraulic fluid to the hydraulic piston, and the hydraulic piston provides the linear force to dispense a fluid product at a rate precisely matching that flow rate of the incompressible hydraulic medium with allowances for pressure ratio differentials between the metered fluid and the dispensed fluid. A rotary valve can be provided to use spent $CO_2$ to retract the piston. The apparatus uses disposable or refillable $CO_2$ cartridges or containers for power. The apparatus is very efficient because it does not eject $CO_2$ with every dispensing cycle but rather maintains continuous pressure on the metered incompressible hydraulic media until the dispensed fluid reservoir is expended. Then the device uses the pressurized $CO_2$ to retract the hydraulic piston before it is finally vented to the atmosphere. These and other features, aspects, and advantages of the present invention will become better understood with regard to the following drawings, description, and claims.

DRAWINGS

DESCRIPTION

The invention is a fluid dispensing apparatus comprising a) a compressed gas or $CO_2$ cartridge power supply, b) a hydraulic pressure medium operatively coupled to the gas cartridge power supply, c) a flow control valve operatively coupled to the hydraulic pressure medium; and d) a hydraulic piston operatively coupled to the hydraulic pressure medium, whereby a $CO_2$ cartridge applies pressure to the hydraulic pressure medium controlled by the $CO_2$ cartridge controller, the flow control valve is operated to precisely meter hydraulic fluid to the hydraulic piston, and the hydraulic piston provides the linear force to dispense a fluid product under pressure.

Figure 1:
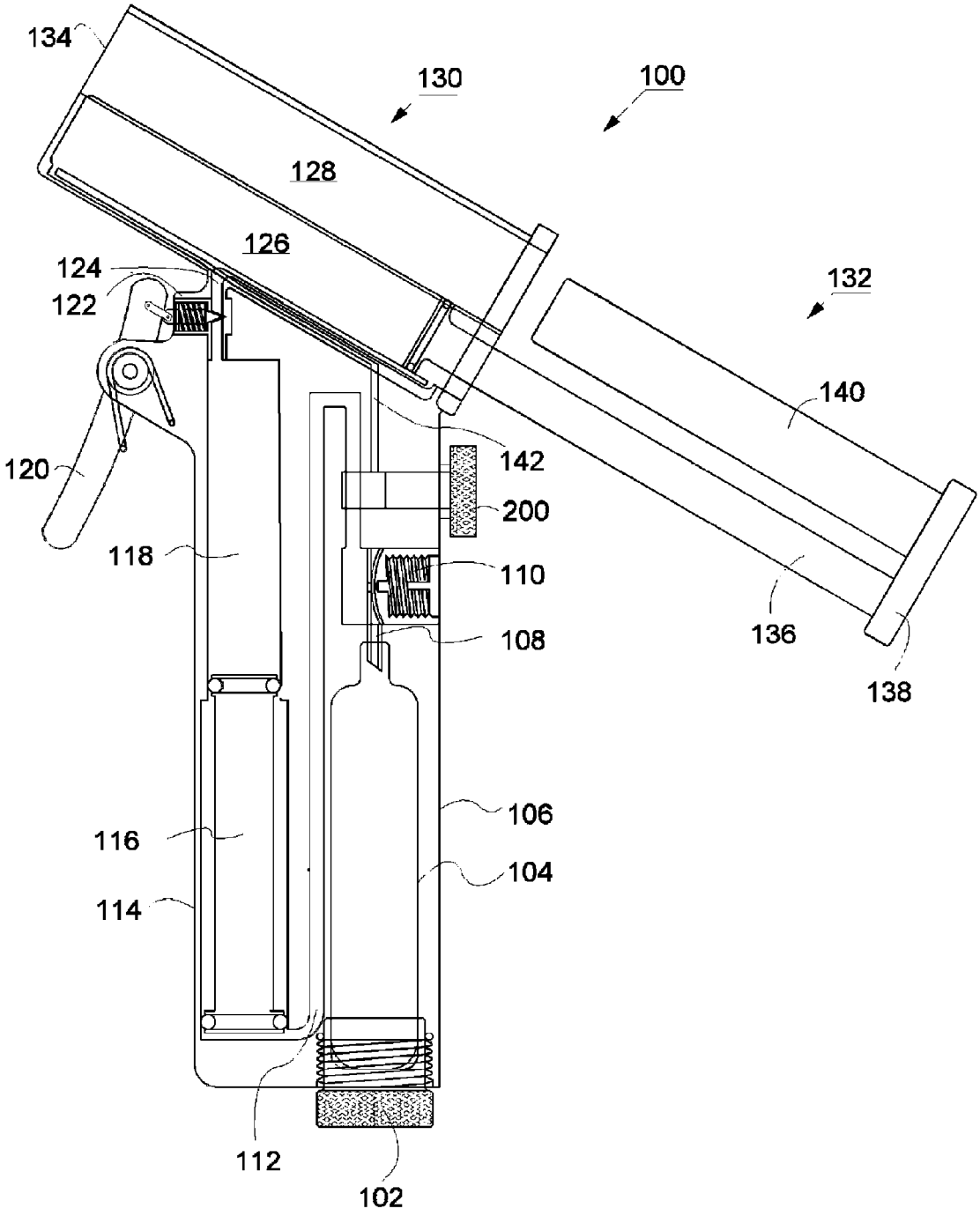
FIG. 1 is a cutaway side elevation of a fluid dispenser apparatus according to the present invention.

FIG. 1 is a cutaway side elevation of the dispensing apparatus 100. A commercially available $CO_2$ cartridge 104 having a standard size and $CO_2$ charge is inserted in a cartridge holder 106. A cap 102 holds the cartridge 104 in the cartridge holder 106. If the cap 102 is threaded, it will also assist advancing the cartridge 104 in the holder 106 until the distal end of a first $CO_2$ tube 108 pierces an end of the cartridge 104, thereby permitting $CO_2$ to flow into the apparatus 100. The proximal end of the first $CO_2$ tube 108 is coupled to a $CO_2$ cartridge controller 110, which is preferably an adjustable pressure relief valve and/or pressure regulator. An integral pressure relief valve limits the pressure applied to, and captive in, the device for safety and consistent performance. Downstream from the cartridge controller is a three-way rotary valve 200 with pressure retract and vent. The rotary valve 200 is also coupled with a retract hydraulic circuit line 142, discussed below.

$CO_2$ is then directed to a hydraulic piston 116 by a second $CO_2$ tube 112. The piston 116 is disposed in a cylinder that is preferably adjacent and parallel with the holder 106. Together, the cylinder and holder 106 form part of the handle 114 of the apparatus 100.

The hydraulic piston 116 operates on a hydraulic pressure medium 118, such that the hydraulic pressure medium is operatively coupled to the $CO_2$ cartridge controller 110. The hydraulic pressure medium 118 is preferably an incompressible liquid. A precise flow control valve 122 is operatively coupled to the hydraulic pressure medium118. The flow control valve 122 can be a needle valve. The user operates a trigger 120 that is coupled to the flow control valve 122 to precisely control the amount of hydraulic pressure medium 118 released.

Figure 2:
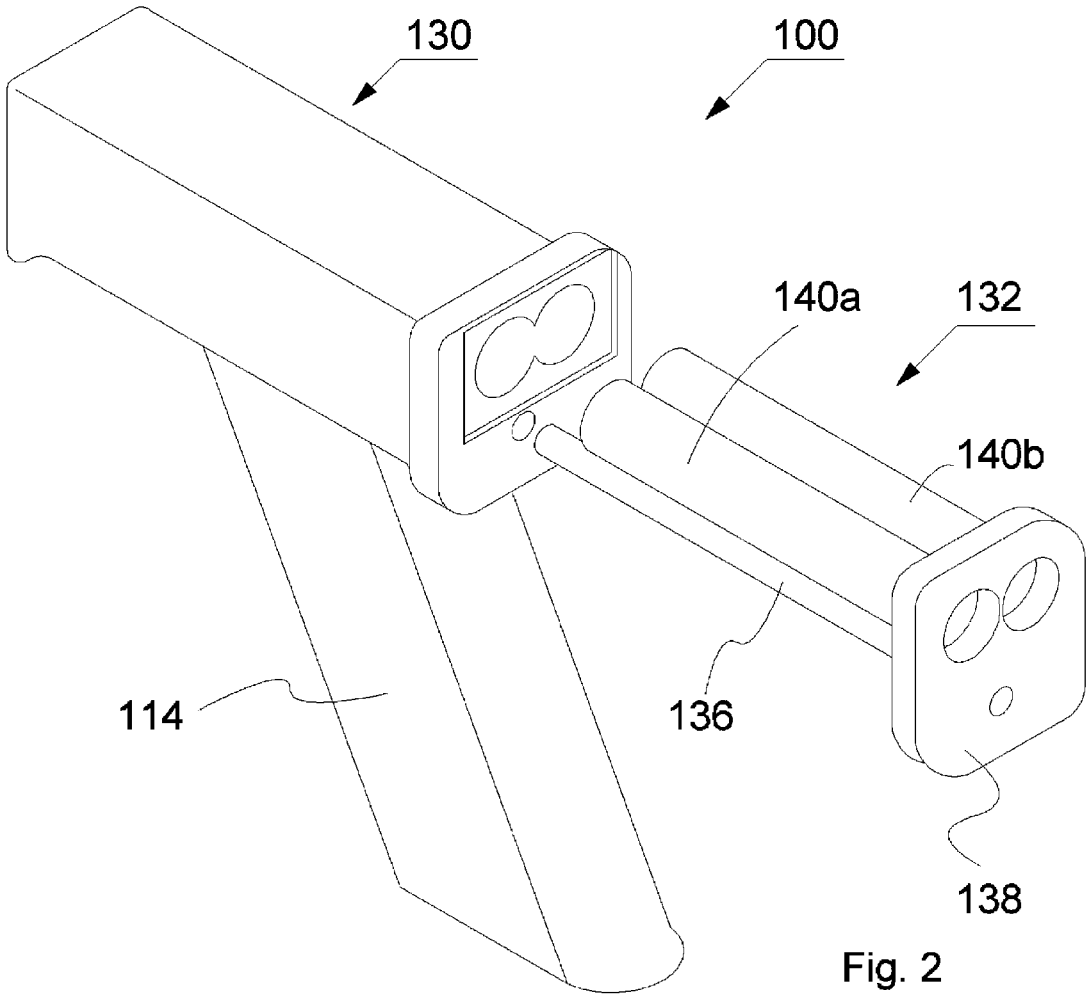
FIG. 2 is an orthogonal view of a fluid dispenser apparatus according to the present invention.

Now turning to both FIGS. 1 and 2 at the same time, the barrel assembly 130 of the apparatus 100 is secured at an angle to the handle 114, like a gun, to make the apparatus easy to use. The barrel assembly 130 is made of a barrel hydraulic cylinder 126 and at least one dispensing fluid chamber 128 parallel to the barrel hydraulic cylinder 126. A tube of the fluid to be dispensed can be placed inside the chamber 128 with the tip of the tube extending through the opening 134.

A plunger assembly 132 is operatively coupled to the barrel assembly 130. The plunger assembly is made of a plunger piston 136, at least one plunger 140, and a plate 138. The plate secures the plunger piston 136 and plunger(s) 140 in a parallel pattern. A single plunger apparatus would be selected, for example, for dispensing a homogeneous material like caulk. An apparatus with two plungers 140*a*, 140*b* would be selected, for example, for dispensing a two-part miscible or reactive resin system where the each component is contained in a cartridge with distinct chambers, usually sided by side.

In operation, the hydraulic pressure medium 118 is directed through a channel or tube 124 to the barrel hydraulic cylinder 126 where it acts upon the plunger piston 136. The force is transferred through the plate 138 to the plunger(s) 140 that forces the fluid to be dispensed from the dispenser tube in the dispensing fluid chamber.

To retract the plunger piston 136, a user would engage the retract circuit by turning the rotary valve 200 to an appropriate position. $CO_2$ in the system still has pressure, and it is directed to the barrel hydraulic cylinder 126 through the retract circuit line 142, and pushes the plunger assembly 132 outward.

Figure 3:
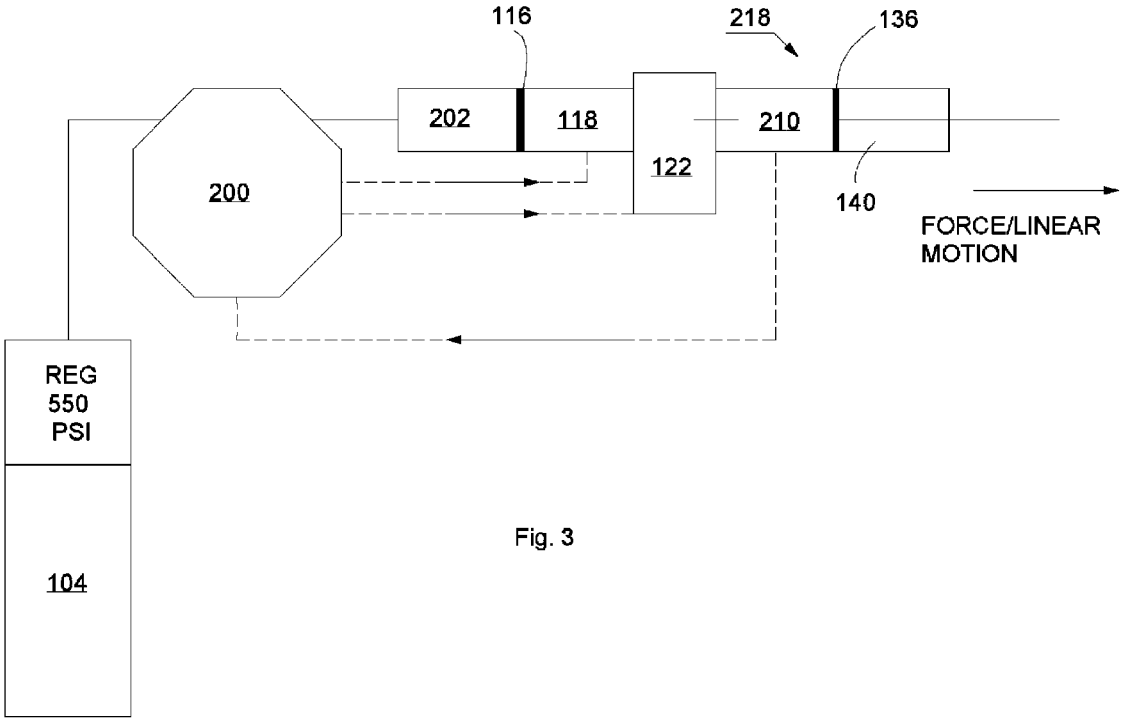
FIG. 3 is a layout of the fluid circuit.
Figure 4:
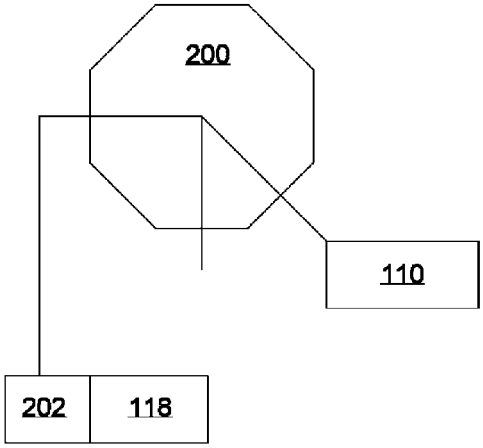
FIG. 4 shows details of the rotary function valve $CO_2$ side.
Figure 5:
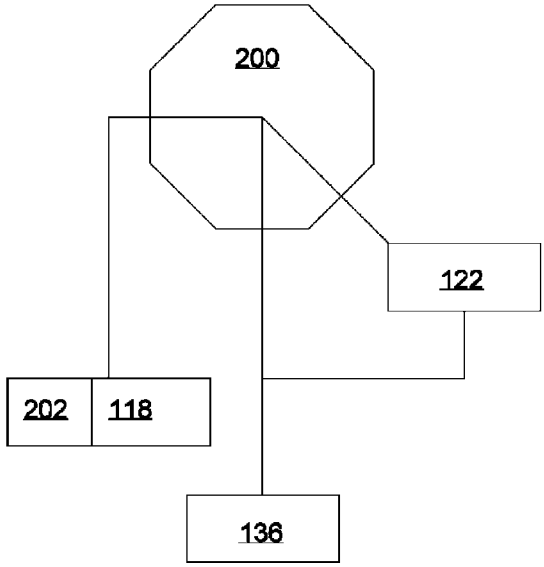
FIG. 5 shows details of the rotary function valve oil side.

FIGS. 3 through 5 show layouts of the apparatus used with a rotary function valve 200. The cartridge 104 supplies $CO_2$ at a substantially constant pressure to the valve 200. The $CO_2$ that has passed through the valve 202 operates on a piston 116 to pressurize hydraulic fluid media 118. A flow control valve 122 precisely meters the media into another media chamber 210 in a pusher assembly 218. The media in the media chamber 210 operates on another piston 136 to produce force and linear motion to a plunger 140.

FIG. 4 shows a schematic of the $CO_2$ side of the rotary function valve 200, which controls flow between the $CO_2$ 202 and a $CO_2$ regulator or pressure relief valve 110. FIG. 5 shows a schematic of the hydraulic fluid media side of the rotary function valve 200. It controls flow between the fluid media supply 118, the pusher cylinder 136 and flow control valve 122. The rotary function valve 200 is operated to retract the pistons and conserve $CO_2$.

The present invention has many advantages over the prior art. It is a self-contained system that provides precise powered movement in a positive displacement linear or rotary hydraulic device that also powers the retraction or reverses rotation to the original position with the spent gas. The system embodies the following principles:

1) To meter a fluid precisely, one should meter an incompressible pressure media rather than the fluid to be dispensed itself, which may contain air and therefore be compressible. This provides a significant increase in control, particularly if the pressurized media is at a pressure significantly greater than that required to provide the dispensed fluid to flow.

2) The use of refillable or disposable $CO_2$ cartridges to provide pressure to an incompressible liquid hydraulic pressure media provides a convenient, constant, easily renewable, easily metered driving force for the hydraulic circuit. Since this hydraulic circuit would be under constant pressure from the $CO_2$ cartridge, this eliminates the need for large volumes of gas in relation to the volume of fluid dispensed as is the case with current devices. This yields a lightweight, efficient, and cost effective dispenser. The system would require a simple cartridge to change or to recharge, and would not be subject to the availability of external power sources for operation or recharge. Furthermore, by metering an incompressible, constant viscosity media, rather than the variable, possibly compressible dispensed fluid, accuracy increases substantially. The metering could take place on either the incoming or outgoing side of a double acting cylinder or hydraulic motor. By metering the incompressible fluid in the $CO_2$/hydraulic circuit, absolute control is achieved over the flow rate with a simple variable volume device such as a needle valve. To retract or return the device to its initial state, the gas in compression on the dispense, or positive, side is first diverted to the negative side of the system and then vented to the atmosphere when retraction is complete.

3) If disposable cartridges are chosen for the power source, recharge is instantaneous. Pressure, and thereby force, is constant through the use of compressed carbon dioxide that is maintained at a maximum of 550 psi by the integral pressure relief valve or regulator regardless of temperature. Drive force is related to the ratio of the displacement area of the rotary or linear device to this pressure.

$$(Pi)\times(\text{Radius Squared})\times\text{Pressure}=\text{Force}$$

That means a 0.5 inch diameter cylinder will supply a linear force of 164 pounds when pressurized by a $CO_2$ cartridge. A 2.0 inch diameter cylinder will supply a linear force of 2,623 pounds when pressurized by a $CO_2$ cartridge. A 4.0 inch diameter cylinder will supply a linear force of 10,493 pounds when pressurized by a $CO_2$ cartridge. And so on.

Adhesives and other fluids are commonly pressurized and metered manually with a form of hand squeeze action ratchet device similar to a caulking gun. Operating these devices by hand over any length of time is fatiguing, tiresome, and can eventually lead to repetitive motion injuries. Battery operated electric dispensers require heavy batteries and frequent recharging. Gas or $CO_2$ cartridges are extremely light in comparison, and store a great amount of energy. Compressed air dispensers require air hose tethers that make handling the apparatus clumsy and difficult. No hoses are needed when one uses $CO_2$ cartridges. Finally, cartridges are commonly available at industrial supply distributors, hardware stores, and consumer retail stores worldwide.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A positioning apparatus comprising:

a first gas conduit having one end adapted to be coupled with a gas-filled cartridge;

a three-way valve operatively coupled with the first gas conduit, the valve having settings to pressurize, retract, and vent;

a second gas conduit having one end operatively coupled to the three-way valve;

a gas/liquid piston having a gas side and a liquid side operatively coupled to the second gas conduit at the piston gas side;

a first hydraulic fluid conduit operatively coupled to the gas/liquid piston at the piston liquid side;

a flow control valve operatively coupled to the first hydraulic fluid conduit;

a second hydraulic fluid conduit operatively coupled to the flow control valve;

a linear hydraulic actuator having an input pressurize side and an input retract side, the pressurize side operatively coupled with the second hydraulic fluid conduit, the linear hydraulic actuator comprising a barrel cylinder and a plunger piston coupled with the barrel cylinder, wherein hydraulic fluid released by controlling the flow control valve entering the barrel cylinder on one side of the plunger piston will position the plunger piston at a desired location and wherein gas released by the three-way valve entering the barrel cylinder on an opposite side of the plunger will retract the plunger piston; and a third gas conduit operatively coupled with the hydraulic actuator retract side on one end and the three-way valve at an opposite end, whereby the respective linear or rotary output of the hydraulic actuator can be precisely controlled and powered by a gas-filled cartridge by adjusting the three-way valve to the pressurize setting, and operating the flow control valve that permits hydraulic fluid to enter the hydraulic actuator and precisely advance its output.

2. The apparatus of claim 1, further comprising a pressure controller in the first gas conduit for limiting the pressure released from a gas-filled cartridge.

3. The apparatus of claim 2, wherein the pressure controller is at least one of an adjustable pressure relief valve and a pressure regulator.

4. The apparatus of claim 1, further comprising a trigger operatively coupled with the flow control valve.

5. The apparatus of claim 1, further comprising a cartridge holder adapted to receive a gas-filled cartridge, the holder being adjacent and parallel to the gas/liquid piston, together comprising a handle capable of being grasped by an operator.

6. The apparatus of claim 5 further comprising a cap adapted to be coupled with the cartridge holder.

7. The apparatus of claim 1, further comprising:

a plunger coupled adjacent to and parallel with the plunger piston wherein one end of the plunger is aligned with one end of the plunger piston; and a chamber adapted to receive a container of a fluid to be dispensed, whereby the plunger presses on one end of the fluid container and forces the dispensed fluid out the other side of the container.

8. The apparatus of claim 1 further comprising a plate coupled to the end of the plunger piston and the end of the plunger that are aligned for securing the piston and the plunger in a parallel configuration.

9. The apparatus of claim 1, further comprising:

two plungers coupled with the plunger piston adjacent to and parallel with the plunger piston wherein one end of each of the two plungers is aligned with one end of the plunger piston; and two chambers each adapted to receive a container of a fluid to be dispensed, whereby the plungers press on one end of the fluid containers and forces the two-part dispensed fluid out the other side of the containers.

10. The apparatus of claim 1 further comprising a hydraulic pressure medium.

11. The apparatus of claim 10, wherein the hydraulic pressure medium is hydraulic fluid.

12. The apparatus of claim 10, wherein the hydraulic pressure medium is an incompressible liquid.

13. The apparatus of claim 1 further comprising a cartridge containing pressurized $CO_2$.

* * * * *